United States Patent [19]

Jahn

[11] 4,227,351

[45] Oct. 14, 1980

[54] CENTRIFUGAL WHEEL ASSEMBLY FOR SPRAYING APPARATUS

[75] Inventor: Wolfgang Jahn, Hagen, Fed. Rep. of Germany

[73] Assignee: Firma Maschinen und Werkzeugfabrik Kabel Vogel & Schemmann, Hagen-Kabel, Fed. Rep. of Germany

[21] Appl. No.: 28,673

[22] Filed: Apr. 10, 1979

[30] Foreign Application Priority Data

Apr. 17, 1978 [DE] Fed. Rep. of Germany ..... 2816602

[51] Int. Cl.[3] ..... B24C 3/02

[52] U.S. Cl. ..... 51/434; 51/435

[58] Field of Search ..... 51/434, 435; 241/275; 416/214 R, 220 A

[56] References Cited

U.S. PATENT DOCUMENTS

| | | | |
|---|---|---|---|
| 2,119,813 | 6/1938 | Keefer | 51/435 X |
| 2,819,562 | 1/1958 | Barnes | 51/435 X |
| 2,869,289 | 1/1959 | Gossard | 51/435 X |
| 3,352,064 | 11/1967 | De Groot | 51/434 |
| 3,785,105 | 1/1974 | Freeman | 51/434 |
| 4,069,025 | 1/1978 | Macmillan | 51/434 |

FOREIGN PATENT DOCUMENTS 2606063 1/1978 Fed. Rep. of Germany .

*Primary Examiner*—Gary L. Smith
*Attorney, Agent, or Firm*—Spencer & Kaye

[57] ABSTRACT

A centrifugal wheel assembly includes a disc-type guide wheel having a rotary axis; and a plurality of impeller vanes oriented radially with respect to the guide wheel. Each impeller vane has oppositely located particle propelling surfaces of identical shape. Each impeller vane has a longitudinal axis and a transverse axis oriented perpendicularly to the longitudinal axis. Both axes are contained in a central plane passing through the impeller vane and oriented parallel to the particle propelling surfaces. The impeller vane is symmetrical with respect to both axes. Each impeller vane further has recesses at its mid length; the recesses are arranged symmetrically with respect to both axes and receive clamping elements for releasably fastening each impeller vane to the guide wheel.

11 Claims, 10 Drawing Figures

CENTRIFUGAL WHEEL ASSEMBLY FOR SPRAYING APPARATUS

BACKGROUND OF THE INVENTION

This invention generally relates to a spraying apparatus for bombarding a workpiece with a jet of solid particles for the cleaning, descaling or similar handling of the workpiece. More particularly, the invention is concerned with a centrifugal wheel assembly which forms part of the spraying apparatus and which includes a disc-type guide wheel and impeller vanes affixed to the guide wheel. The particles of the material to be sprayed are guided by the impeller vanes in the radial direction, accelerated and propelled outwardly by centrifugal force. The impeller vanes are, due to the particles impinging thereon and due to their high speed, exposed to substantial wear necessitating their relatively frequent replacement.

It is conventional to structure the two opposite sides of each impeller vane identically so that either side is adapted to function selectively as the propelling surface for the material. Such a design, on the one hand, makes possible a drive of the centrifugal wheel assembly in either rotary direction and, on the other hand, permits a selective installation of each impeller vane at a 180° inverted position with respect to the longitudinal axis of the impeller vane. It is a requisite in such structures that the impeller vanes be easily removable, that they be located at areas protected from wear and that their operationally safe immobilization (fixation) be ensured. In an arrangement disclosed in German Auslegeschrift (Accepted Published Patent Application) No. 2,606,063, the immobilization of the impeller vanes in the centrifugal wheel assembly is effected by an impeller foot of dovetail shape inserted into a complemental groove and is maintained in place by leaf springs. In a centrifugal wheel assembly disclosed in German Offenlegungsschrift (Laid-Open Application) No. 2,634,198, the immobilization of the impeller vanes is effected by cams which are provided in the reinforced longitudinal edges of the impeller wheels adjacent their ends and project into a slot provided in a disc-type guide wheel. The known centrifugal wheels can be installed and used only in the two selected positions as described above.

SUMMARY OF THE INVENTION

It is an object of the invention to provide an improved centrifugal wheel assembly of the above-outlined type which permits a selective four-position installation and use of the impeller vanes.

This object and others to become apparent as the specification progresses, are accomplished by the invention, according to which, briefly stated, each impeller vane has a configuration that is symmetrical to the longitudinal axis of the impeller vane and to a transverse axis thereof which is perpendicular to the longitudinal axis and which is contained in a central plane extending parallel to the two opposite impeller faces. Each impeller vane further has recesses which serve for accommodating fastening elements formed as clamping members and which are arranged symmetrically relative to the transverse axis. By means of the fastening elements the impeller vanes are affixed to the guide wheel.

Thus, according to the invention, each impeller vane is fully symmetrical with respect to two mutually perpendicular axes and consequently, a four-position installation of the impeller vanes is feasible. Thus, each impeller vane can be reversed 180° about its longitudinal axis and also, 180° about the transverse axis and affixed in the selected orientation to the disc-type guide wheel. Also, because of the symmetry relative to the longitudinal vane axis, the centrifugal wheel can be rotated in either direction. By virtue of the symmetry with respect to the transverse axis, an inversion of 180° of the guide wheel together with the impellers as a unit is feasible, making possible a left-hand and right-hand rotation. The same effect is achieved by transposing the vane-fastening clamping elements to that side of the respective impeller vane which is oriented away from the direction of rotation. Thus, according to the invention, the impeller vanes can be utilized in an optimal manner and thus a maximum total service life can be achieved.

DESCRIPTION OF THE PREFERRED EMBODIMENT

Figure 1A:
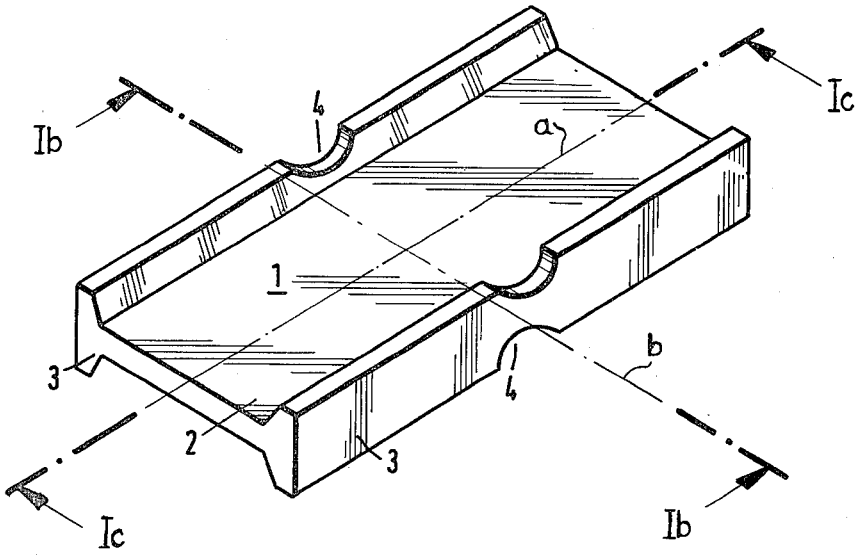
FIG. 1*a* is a perspective view of an impeller vane according to the invention.
Figure 1B:
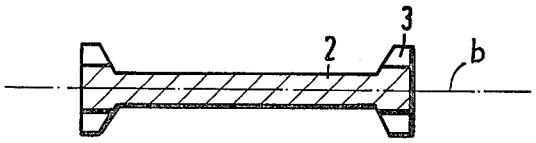
FIGS. 1*b* and 1*c* are sectional views taken along lines Ib-Ib and Ic-Ic, respectively, of FIG. 1*a*.
Figure 1C:
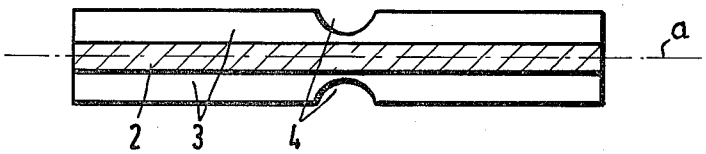
Figure 2B:
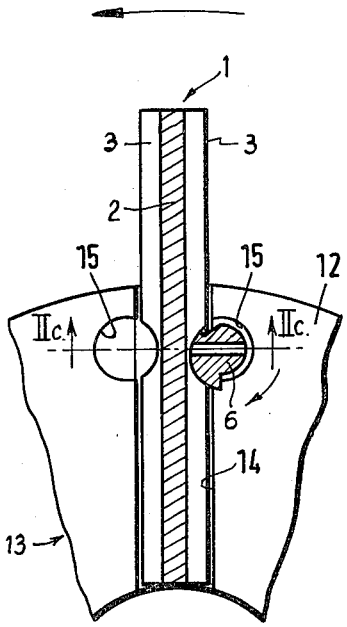
FIG. 2*b* is a sectional view taken along line IIb-IIb of FIG. 2*c* of the same arrangement, with the impeller vane in place.
Figure 2A:
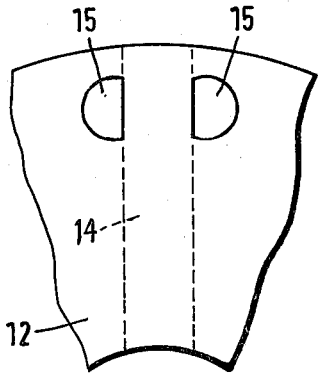
FIG. 2*a* is a fragmentary plan view of a disc-type guide wheel forming part of a centrifugal wheel assembly according to the invention, with the impeller vane removed.
Figure 2C:
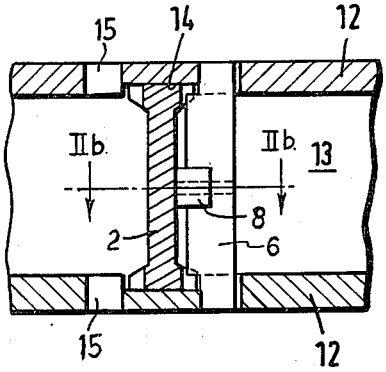
FIG. 2*c* is a sectional view taken along line IIc-IIc of FIG. 2*b*.

Turning now to FIGS. 1*a*, 1*b* and 1*c*, the impeller vane 1 according to the invention is formed essentially of a rectangular base plate 2, two opposite faces of which can selectively serve as the slide faces for the particles to be propelled. Along each longitudinal edge the base plate 2 has a rib-like rim 3 whereby the cross section (or end view) of the impeller vane 1 has a dual T configuration. The transition from the base plate 2 to the lateral rims 3 is rounded as required by forging or casting technology. In the mid length of each rim 3 there are provided two back-to-back arranged recesses 4 which are substantially of semicircular configuration. Each recess 4 serves to accommodate an eccentric clamping element 6 as will be described in greater detail below. The impeller vane 1 has a longitudinal axis a and a transverse axis b which is perpendicular to the axis a and which halves the impeller vane 1. Both axes a and b lie in a central plane which is parallel to the two opposite work faces of the base plate 2. The impeller vane 1, including the four recesses 4, is of symmetrical configuration both with respect to the longitudinal axis a and the transverse axis b.

Figure 3B:
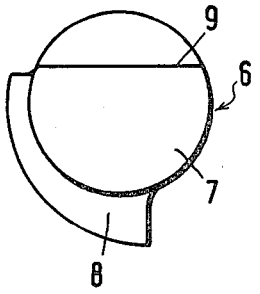
FIG. 3*b* is an end view of the structure shown in FIG. 3*a*.
Figure 3A:
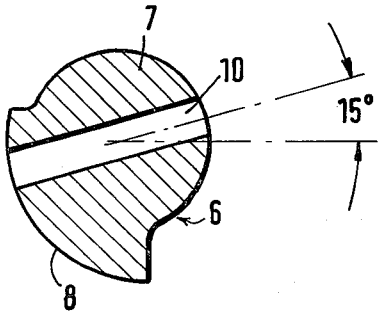
FIG. 3*a* is a cross-sectional view of an impeller vane clamping element according to the invention.
Figure 3C:
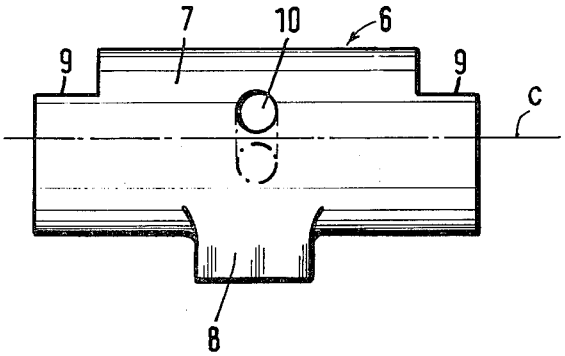
FIG. 3*c* is a side elevational view of the structure shown in FIGS. 3*a* and 3*b*.

Turning now to FIGS. 3*a*, 3*b* and 3*c*, each eccentric clamping element generally indicated at 6 has an axle-like body 7 which, at its mid length, is provided with a radial cam 8. The latter, viewed in the circumferential direction of the element 6, has a spiral course about the longitudinal axis c of the body 7. At each end of the body 7 there is provided a planar shoulder 9. The surfaces of the shoulders 9 are contained in a single plane which bounds, at one end, a terminus of the cam 8 as may be best observed in FIG. 3*b*. The cam extends through approximately 145° about the circumference of the body 7. At mid length, the body 7 is provided with a throughgoing bore 10 which is oriented perpendicularly to the longitudinal axis c of the body 7 and which is at an acute angle of, for example, 15° with respect to the plane defined by the shoulders 9.

Turning now to FIGS. 2*a*, 2*b*, 2*c* and 4, the impeller vane 1 is inserted into a double disc-type guide wheel 13 formed of two parallel-spaced guide discs 12. The guide wheel 13 which is a single-piece component, is provided with a plurality (four to eight) of radial grooves 14. On either side of each groove 14, as may be best observed in FIG. 2*b*, in the discs 12, there are provided arcuate openings 15 for accommodating the eccentric clamping elements 6. The openings 15 are at identical radial distances from the rotary axis of the guide wheel 13. Into aligned openings 15 in the guide discs 12 within the same groove 14, there can be inserted — in a direction parallel to the axis of the guide wheel 13 — one clamping element 6 in such a manner that the shoulders 9 of the element 6 are oriented in the radial direction of the wheel 13. This, upon insertion of the impeller vane 1 into the respective groove 14, permits the ribs 3 to be pushed past the element 6. After inserting the impeller vane 1, the eccentric clamping element 6 (which is on the then idle working surface of the base plate 2) is turned about its axis c by a tool inserted into the bore 10, so that the non-flattened end zones of the body 7 is brought into the recesses 4. The element 6 is turned until the cam 8 engages the base plate 2 and is pressed thereagainst as a frictional lock. The cam 8, relative to the rotary axis of the guide wheel 13 engages the base 2 from below so that upon rotation of the guide wheel 13, the eccentric clamping element 6 is pressed to an increased extent against the base plate 2 of the impeller vane 1 under the effect of centrifugal forces imparted to the impeller vane 1.

Figure 4:
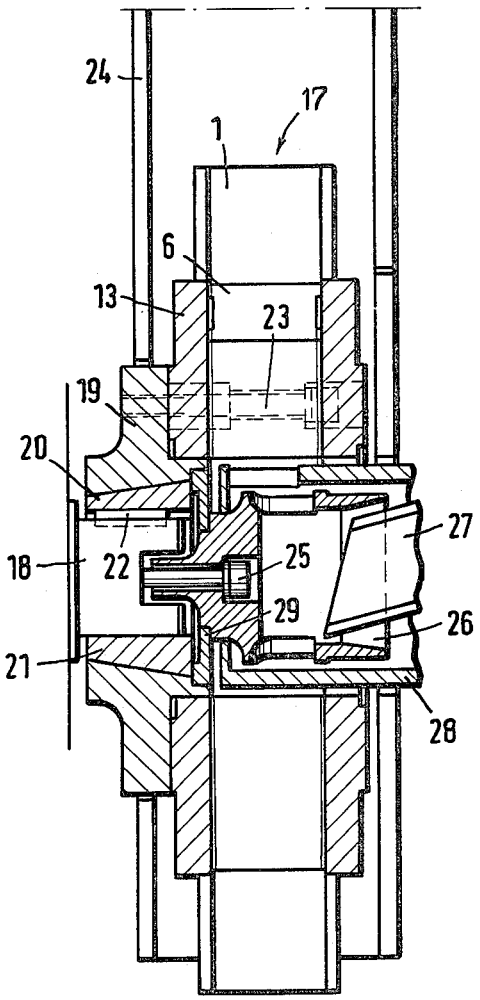
FIG. 4 is an axial sectional view of a centrifugal wheel assembly according to the invention.

Reverting now in particular to FIG. 4, the dual disc-type guide wheel 13 is a component of the centrifugal wheel assembly 17 which is driven by a shaft 18 on which there is secured, by means of a conical sleeve 21 and a wedge 22, a hub 20 provided with a flange 19. On the hub 20 there is centered the guide wheel 13 which is secured to the flange 19 by bolts 23. As described above, to the guide wheel 13 there are secured, by means of the eccentric clamping elements 6, at least two, but generally no more than eight impeller wheels 1. The centrifugal wheel assembly 17 rotates in a housing 24.

An impeller cage 26 is affixed to the shaft 18 by a groove-and-screw connection 25 arranged in the rotary axis of the shaft 18. The impeller cage 26 has radial apertures, as well as an axially oriented opening into which merges a supply tube 27. The material introduced by the supply tube 27 is, with the aid of the impeller cage 26, radially distributed onto the guide wheel 13 and is thus entrained by the impeller vanes 1. A non-rotary guide sleeve 28 is adjustably secured to the outer housing 24 of the centrifugal wheel assembly 17. The guide sleeve 28 surrounds the impeller cage 26 and extends immediately up to an intermediate ring 29 which is arranged adjacent the shaft 18. The impeller cage 26 serves for dosing and distributing the spray material. By adjusting the guide sleeve 28, the direction of material ejection (jet) can be controlled.

It is to be understood that the above description of the present invention is susceptible to various modifications, changes and adaptations, and the same are intended to be comprehended within the meaning and range of equivalents of the appended claims.

What is claimed is:

1. In a centrifugal wheel assembly including a disc-type guide wheel having a rotary axis; a plurality of impeller vanes oriented radially with respect to the guide wheel; each impeller vane having a longitudinal axis and oppositely located particle propelling surfaces being of identical shape and being arranged symmetrically with respect to the longitudinal axis; and securing means for releasably fastening each impeller vane to the guide wheel; the improvement wherein each said impeller vane is of symmetrical structure with respect to a transverse axis oriented perpendicularly to said longitudinal axis and contained in a central plane passing through the respective impeller vane and being parallel to said particle propelling surfaces; the improvement further comprising means defining recesses in each impeller vane at mid length thereof; said recesses being arranged symmetrically with respect to said longitudinal and transverse axes; said securing means comprising clamping elements received in said recesses.

2. A centrifugal wheel assembly as defined in claim 1, wherein said disc-type guide wheel comprises two parallel-spaced discs extending perpendicularly to and concentrically with said rotary axis and having inner disc faces oriented to one another.

3. A centrifugal wheel assembly as defined in claim 2, wherein said guide wheel is a single-piece, rigid component.

4. A centrifugal wheel assembly as defined in claim 2, further comprising a plurality of grooves provided in said inner disc faces; said grooves being arranged in pairs in a radial orientation with respect to said rotary axis; the grooves forming a pair being provided in opposite inner disc faces and being in a parallel, aligned relationship with one another; the two grooves of each pair together receiving a respective said impeller vane.

5. A centrifugal wheel assembly as defined in claim 4, further comprising means defining a plurality of openings provided in each said disc and arranged at identical radial distances from said rotary axis; each said groove being flanked by the openings; said openings being arranged in pairs; the openings forming a pair being provided in opposite discs and being in an aligned relationship with one another; the openings of one opening pair being in alignment with respective two recesses of the respective impeller vane inserted in the respective grooves for together receiving one of said clamping element.

6. A centrifugal wheel assembly as defined in claim 5, wherein each said clamping element comprises an axle-like body having a longitudinal axis; a camming face arranged at least approximately at mid length of said body and extending in a spiral course about the longitudinal axis of said body; said cam face being arranged to frictionally engage one of said surfaces of said impeller vane for clamping the impeller vane against sides of the respective cooperating grooves.

7. A centrifugal wheel assembly as defined in claim 6, wherein each clamping element has a shoulder at each end; the shoulders defining faces lying in a single plane that extends parallel to the longitudinal axis of the respective clamping element; each said clamping element, when received by the respective opening pair of said discs, is arranged to assume a first angular position in which the faces defined by said shoulders are oriented radially with respect to said rotary axis of said guide wheel and said cam face is in an inoperative state for permitting a radial sliding movement of the impeller vane in the respective groove pair relative to the guide wheel and a second angular position in which circumferential, non-planar portions of the clamping element extend into the respective recess of said impeller vane and said cam face is in its frictionally engaging state.

8. A centrifugal wheel assembly as defined in claim 7, wherein each clamping element has a bore arranged at approximately mid length of the clamping element and oriented perpendicularly to the longitudinal axis thereof; said bore having an axis defining an acute angle with said single plane.

9. A centrifugal wheel assembly as defined in claim 1, wherein each impeller vane comprises a base plate having opposite faces which constitute said particle propelling surfaces and lateral ribs extending parallel to said longitudinal axis along opposite edges of each said impeller vane; said recesses are provided in said ribs and are substantially of semicircular, open configuration.

10. A centrifugal wheel assembly as defined in claim 1, further comprising a drive shaft; a flanged hub affixed to said guide wheel and a conical sleeve arranged within said hub and surrounding said drive shaft; said conical sleeve wedging said hub to said drive shaft.

11. A centrifugal wheel assembly as defined in claim 1, wherein each said clamping element comprises an axle-like body having a longitudinal axis; a camming face arranged at least approximately at mid length of said body and extending in a spiral course about the longitudinal axis of said body; a shoulder at each end; the shoulders defining faces lying in a single plane that extends parallel to the longitudinal axis of the respective clamping element; and a bore arranged at approximately mid length of the clamping element and oriented perpendicularly to the longitudinal axis thereof; said bore having an axis defining an acute angle with said single plane.

* * * * *